US006102592A

United States Patent [19]

Herbert

[11] Patent Number: 6,102,592

[45] Date of Patent: Aug. 15, 2000

[54] METHOD AND APPARATUS FOR PRINTING AND PREVENTION OF COPYING OF POSTAGE INDICIA

[75] Inventor: Raymond John Herbert, Leigh-on-Sea, United Kingdom

[73] Assignee: Neopost Limited, Essex, United Kingdom

[21] Appl. No.: 09/013,064

[22] Filed: Jan. 26, 1998

[30] Foreign Application Priority Data

Jan. 29, 1997 [GB] United Kingdom ..... 9701830

[51] Int. Cl.[7] ..... B41J 5/30

[52] U.S. Cl. ..... 400/106; 382/101; 705/405; 705/408

[58] Field of Search ..... 400/106, 61; 382/101; 705/405, 408

[56] References Cited

U.S. PATENT DOCUMENTS 4,900,904 2/1990 Wright et al. ..... 234/381

5,302,825 4/1994 Abumehdi et al. ..... 250/271

OTHER PUBLICATIONS

International Search Report with enclosures.

*Primary Examiner*—John S. Hilten

*Attorney, Agent, or Firm*—Shoemaker and Mattare, Ltd.

[57] ABSTRACT

Postage indicia are printed on mail items using an ink having a characteristic such that the ink is rendered invisible when subjected to light or light and heat of sufficient intensity. When an attempt is made to copy the imprint of a postage indicia on a mail item for which proper accounting has been effected the imprint is subjected to a butst of light or light and heat and the ink becomes invisible and prevents copying of the imprint. The imprint of the postage indicium may overly and obscure a void mark which becomes visible and is copied in the event of attempting to copy the original authentic postage indicium.

12 Claims, 3 Drawing Sheets

METHOD AND APPARATUS FOR PRINTING AND PREVENTION OF COPYING OF POSTAGE INDICIA

BACKGROUND OF THE INVENTION

This invention relates to franking mail items in which a postage indicium is printed on the mail item to provide evidence that accounting for a postage charge in respect of the mail item has been effected.

Postage meters are well known in which a user can input, by means of a keyboard, a desired postage charge for a mail item and the postage meter then carries out accounting functions in respect of the required postage charge and prints a postage indicium on the mail item. The postage indicium includes data indicative of the postage charge applied whereby post office personnel can check that the correct postage charge has been applied taking into account the weight, class of postal service and destination of the item. Although the ink used to print the postage indicium is of a specified colour and quality which is not available for use in equipment other than postage meters, with the advent of photocopiers capable of copying coloured imprints it is relatively easy to make copies of printed postage indicia which are reproduced with sufficient accuracy as to present a printed image which appears to be authentic. Accordingly by the use of a colour photocopier mail items bearing what appears to be a genuinely printed postage indicium can be created. However, it will be appreciated that copies of postage indicia on mail items result in fraud on the postal authority because no accounting or payment has been made in respect of the copies of postage indicia. Copying of postage indicia could result in significant financial loss to a postal authority and particularly if postage indicia indicating high values of postage charge are copied. Accordingly it is of significant interest to postal authorities to prevent copying of postage indicia.

SUMMARY OF THE INVENTION

According to a first aspect of the invention a method of preventing copying of a postage indicium printed on a mail item, said copying including subjection of the printed postage indicium to light or light and heat and said postage indicium providing evidence that accounting for a postage charge in respect of said mail item has been effected, includes the step of printing the postage indicium with an ink having a characteristic such that when subjected to light or heat of sufficient intensity the ink is rendered invisible whereby the postage indicium printed with said ink is rendered invisible.

According to a second aspect of the invention a method of printing a postage indicium on a mail item, said postage indicium providing evidence that accounting for a postage charge in respect of said mail item has been effected, includes the step of printing the postage with an ink having a characteristic such that when subjected to light or light and heat of sufficient intensity the ink is rendered invisible whereby the postage indicium printed with said ink is rendered invisible thereby preventing copying of said postage indicium in which the imprint of the postage indicium is subjected to a burst of light of intensity sufficient to render the ink invisible.

According to a third aspect of the invention postage metering apparatus includes electronic accounting and control means operable in a franking operation to carry out accounting functions in respect of a postage charge to be applied in respect of a mail item; a first print head operable to form an imprint on the mail item with a first ink having a first characteristic such that said first ink is rendered invisible in response to subjection of the ink to a burst of light of sufficient intensity; a second print head operable to form an imprint on the mail item with a second ink having a second characteristic such that the second ink remains visible when subjected to said burst of light; and said electronic accounting and control means being further operable in said franking operation to effect operation of said second print head to print a marking on the mail item and to effect operation of the first print head to print a postage indicium on the mail item providing evidence of accounting for said postage charge; said first print head being so operated that the postage indicium overlies at least a part of said marking printed by said second print head.

BRIEF DESCRIPTION OF THE DRAWING

An embodiment of the invention will be described hereinafter by way of example with reference to the drawings in which.

DESCRIPTION OF THE PREFERRED EMBODIMENT

Figure 1:
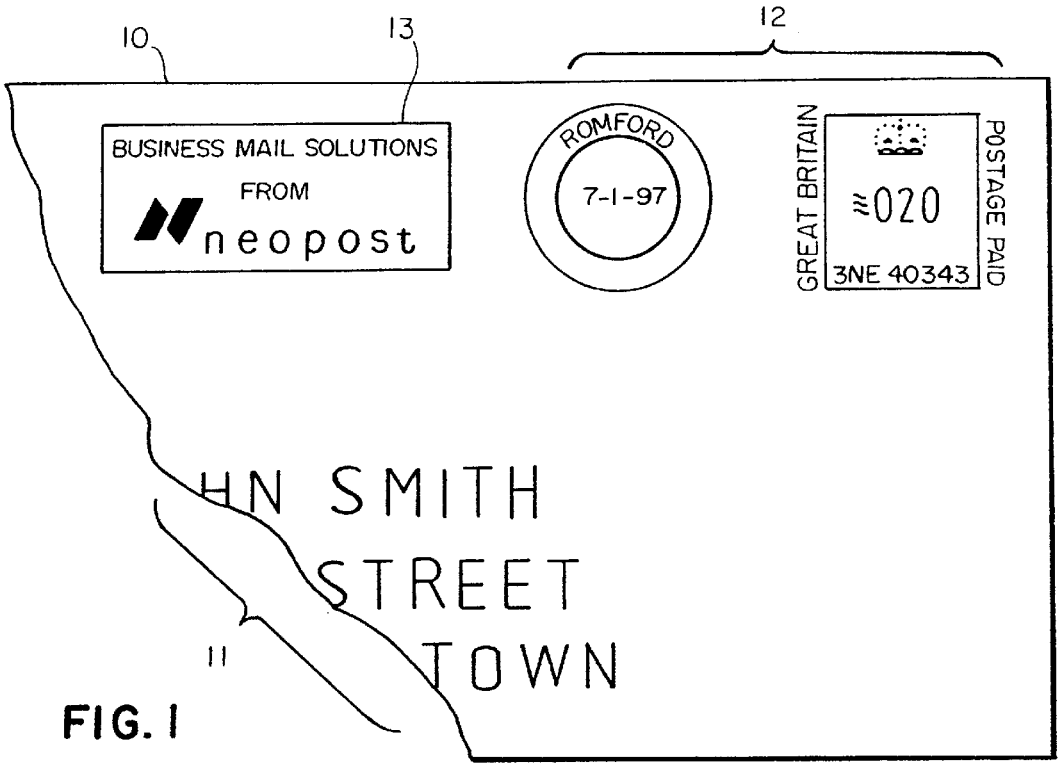
FIG. 1 illustrates a mail item bearing an imprint of a postage indicium thereon.

Referring first to FIG. 1 of the drawings, a mail item comprising an envelope 10 bears destination information 11 and a typical postage indicium 12 printed thereon. The postage indicium provides evidence that accounting has been effected in respect of a postage charge for handling the mail item. Optionally the mail item 10 may bear an advertising slogan 13 as shown in FIG. 1. The postage indicium must be of a form and contain postage information as required and authorised by a postal authority. The form and information content of postage indicia may be different for postal authorities in different countries. When printed using conventional inks it is possible to make photocopies of the postage indicia and hence a single authentic printed postage indicia may be reproduced on a plurality of envelopes. With currently available colour photocopiers it is possible to reproduce the authentic printed postage indicium with sufficient accuracy of form and colour that reproductions of the authentic indicium may appear to be authentic. It will be appreciated that reproduction of a single authentic postage indicium results in evasion of payment of postage charges in respect of postal items to which the reproduced postage indicia are applied.

Figure 2:
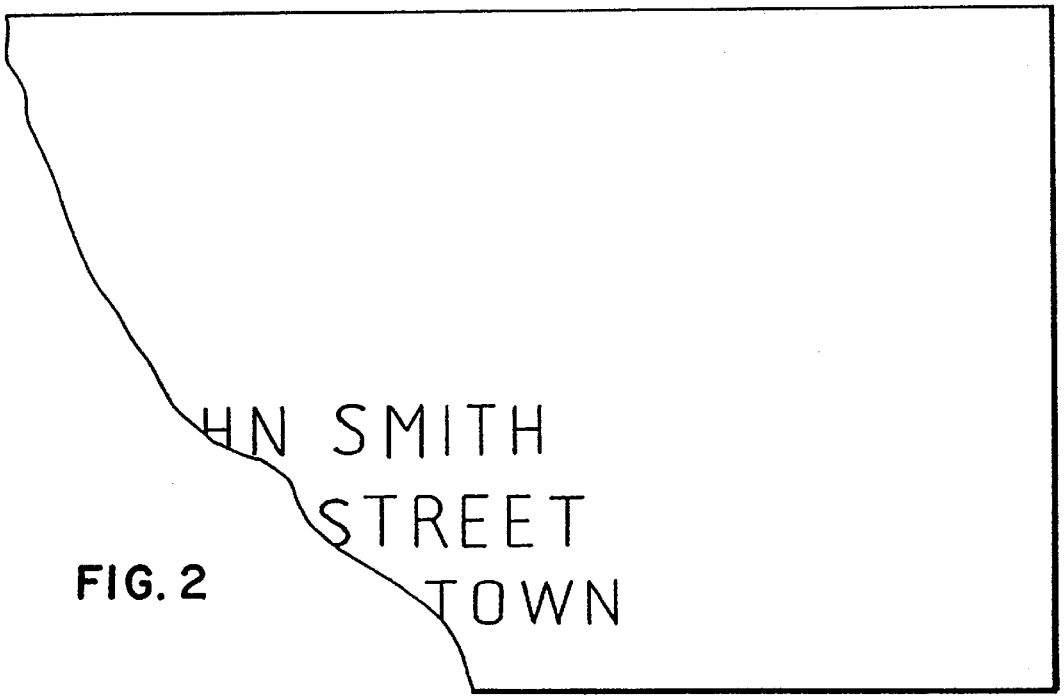
FIG. 2 illustrates a photocopy of the mail item illustrated in FIG. 1.

However inks are now being developed which respond to brief bursts of light and, when subjected to a burst of light of sufficient intensity, are briefly rendered invisible. Inks having this characteristic are under development by Rank Xerox as disclosed in The Sunday Times dated Mar. 3, 1996. In operation of a photocopier, the original image to be copied is subjected to a burst of light as the image is scanned and the burst of light is of sufficient intensity to render invisible an image printed with an ink having the aforesaid characteristic. Accordingly if a mail item bearing an authentic postage indicium is printed with an ink rendered invisible in response to subjection of the ink to burst of light is placed as an original to be copies in a photocopier, during operation of the photocopier the postage indicium will be subjected to a burst of light of an intensity such as briefly to render the image invisible. As a result, since the postage indicium is rendered invisible during scanning of the indicium by the photocopier, the authentic postage indicium will not be reproduced by the photocopier and a reproduction of the mail item appears as shown in FIG. 2 with no postage indicium. However the original authentic postage indicium is visible again after the scanning of the indicium has ended. Accordingly the original authentic postage indicium continues to indicate payment of postage charge in respect of the item processed authentically but no additional mail items purporting to have postage charges applied thereto can be reproduced from the authentic item.

In addition to the use of ink which is rendered invisible by burst of light for printing the postage indicia, the imprint of the postage indicia in light responsive ink may be of a form and so located as to obscure at least a part of an imprint of a marking printed in normal ink indicating that the mail item is void. Under normal ambient light conditions the postage indicium is visible and the void mark is at least partially obscured. However when subjected to bursts of light in a photocopier the ink with which the postage indicia is printed is rendered invisible and transparent thereby revealing the void mark. Accordingly the postage indicium is not reproduced whereas the void mark is reproduced.

Figure 3:
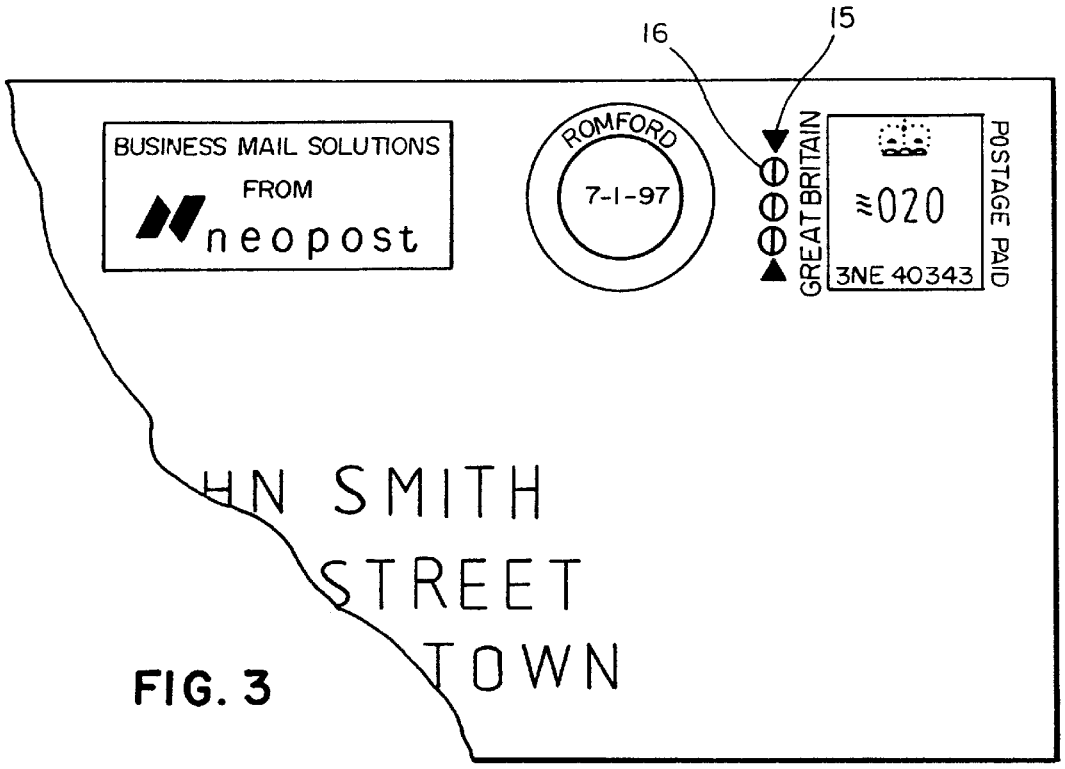
FIG. 3 illustrates a mail item bearing a modified postage indicium imprinted to overly a void mark on the mail item.
Figure 4:
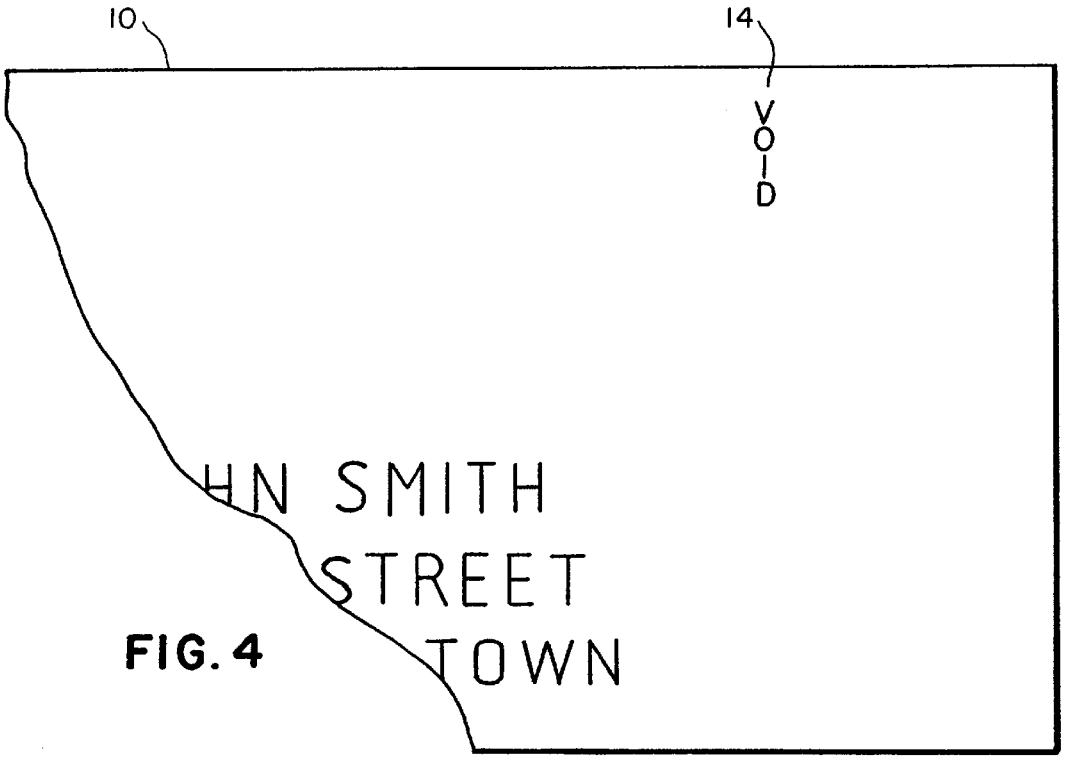
FIG. 4 illustrates a photocopy of the mail item of FIG. 3.

An example of a void mark which can be obscured by a modified postage indicium is shown in FIG. 4. The mail item 10 is firstly imprinted with the void mark 14 illustrated in FIG. 4 and then the mail item is imprinted with a postage indicium of a form and so located as to overprint at least a portion of the void mark. For example the postage indicium 12 may be as illustrated in FIG. 3. The void mark 14 is printed with normal ink unaffected by bursts of light and the postage indicium 12 is printed with ink having the aforesaid characteristic so that the ink is rendered invisible when subjected to bursts of light of sufficient intensity. Accordingly under normal ambient light, the mail item appears as in FIG. 3 but when reproduction of the postage indicia is attempted a photocopy of the mail item appears as in FIG. 4 with no postage indicium but with the void mark 14 visible.

While examples of postage indicium 12 and void mark 14 are illustrated in FIG. 3 and 4 it is to be understood that any desired form of postage indicium and void mark may be printed provided that the void mark is either obscured or rendered unrecognisable as a void mark. For example the void mark may be totally obscured by the postage indicium or parts of the void mark may remain unobscured and visible, these parts being selected such that they have no recognisable meaning and these parts may appear to be a part of the postage indicium.

In the illustrated example of FIG. 3 and 4, the void mark 14 comprises the words VOID. The postage indicium 12 is printed with an opaque triangular region 15 which extends over and obscures the character 'V' of VOID. The postage indicium is printed also with patterns 16 having the form 'O' so located as to overly the characters 101 and 'D' of the printed void mark. A pattern 'O' is printed to encircle the character 'I' of the printed void mark. The ink areas imprinted when printing the postage indicium are of such extent as to overprint required portions of the void marking even with misalignment, within a tolerance limit, of the printing of the void mark and the postage indicium. It will be appreciated that in this example of printed postage indicium and void mark, the characters 'V', 'O' and 'D' are totally obscured by portions of the imprint of the postage indicium whereas the character 'I' of the void mark is not overprinted and is visible to appear as part of the postage indicia. Thus the printing of the postage indicium may be such as to obscure all portions of the void mark or to obscure some portions of the void mark and to incorporate unobscured portions of the void mark as portions of the postage indicium.

Figure 5:
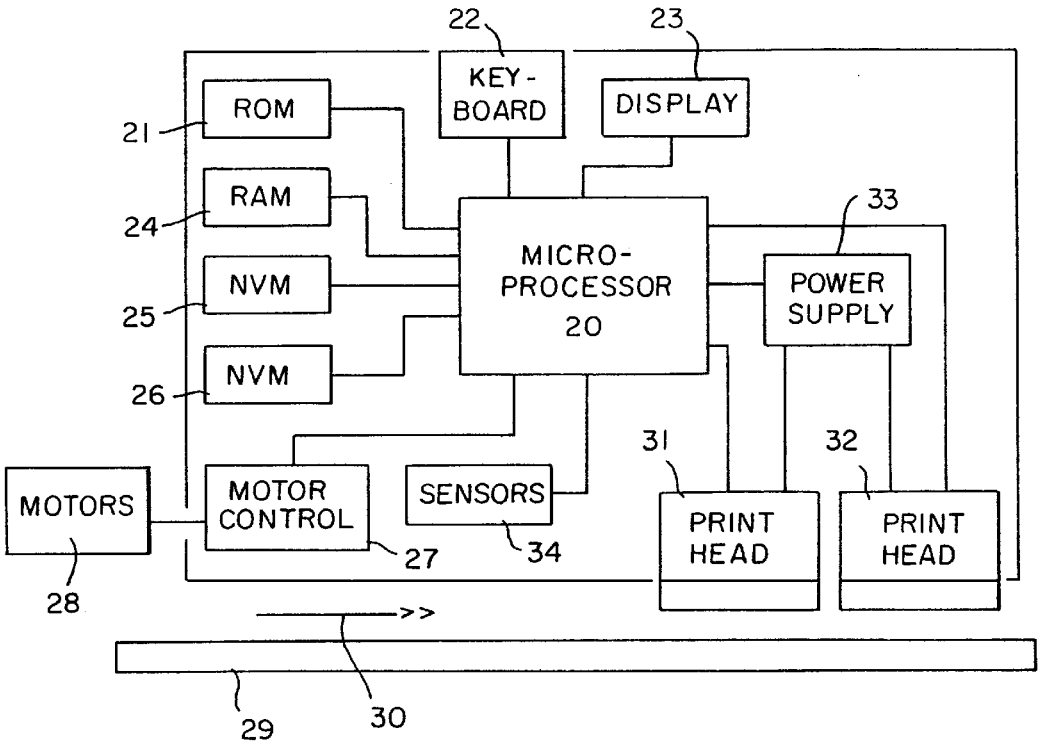
FIG. 5 illustrates a postage meter provided with a two stage printing station.

If desired the envelope may be pre-printed with a void mark which is subsequently overprinted when the envelope is processed by a postage meter. Alternatively the postage meter may be constructed and arranged to print firstly the void mark in normal ink and then to print the postage indicium with the aforesaid light responsive ink overlying the imprint of the void mark. A postage meter for printing both a void mark and a postage indicium on a mail item is illustrated diagrammatically in FIG. 5 to which reference will now be made.

The postage meter includes electronic accounting and control means comprising a micro-processor 20 operating under program routines stored in a read only memory (ROM) 21. A keyboard 22 is provided for input of commands and data by a user and a display 23 is provided to enable display of information to the user. A random access memory (RAM) 24 is provided for use as a working store for storage of temporary data during operation of the postage meter. Non-volatile duplicated memories 25, 26 are provided for the storage of critical data relating to use of the postage meter and which is required to be retained even when the postage meter is not powered. The microprocessor 20 carries out accounting functions in relation to use of the postage meter for franking mail items with postage charges applicable to handling of the mail items by the postal authority or another carrier. Accounting data relating to use of the postage meter for printing franking impressions representing postage charges for mail items and any other critical data to be retained is stored in the non-volatile memories 25, 26.

A motor controller 27 is controlled by the microprocessor 10 to control operation of motors 28 driving feeding means (not shown) for feeding a mail item 29 in the direction of arrow 30 past a first digital print head 31 and a second digital print head 32. Preferably the print heads are thermal print heads including selectively energisable thermal printing elements but may be other types of digital printing heads. Sensors 33 are provided to sense and monitor feeding of the mail item 29 past the print heads and to provide signals to the microprocessor to enable the microprocessor to control feeding of the mail item and to effect selective energisation of the thermal print elements of the print heads 31, 32 from a power supply 34 at appropriate times. The microprocessor effects selective energisation of the printing elements of print head 31 to print the void mark, for example as shown in FIG. 4 and effects selective energisation of the printing elements of print head 32 to print a postage indicium, for example as shown in Fibre 3. Operation of the print head 32 is delayed relative to operation of print head 31 so that the postage indicium printed by the head overlies and obscures the void mark as explained hereinbefore with reference to FIGS. 3 and 4. When it is desired to print an advertising slogan 13, the slogan would usually be printed by the print head 32 used to print the postage indicium and hence the slogan will not be reproduced in an attempt to photocopy the postage indicium. However if desired the slogan 13 may be printed by the print head 31 and the slogan will be reproduced together with the void mark 14.

Hereinbefore the ink has been described as being rendered invisible when subjected to a burst of light of sufficiently high intensity. When an imprint is photocopied by photocopier, the imprint is scanned by a source of illumination and hence is subjected to the burst of light. It will be appreciated that the source of light generally emits a significant amount of heat. Accordingly the imprint is also subjected to heat from the source and hence the postage indicium may be printed with an ink which has a characteristic such that the ink is rendered invisible when subjected to heat.

I claim:

1. A method of preventing copying of a postage indicium printed on a mail item, said copying requiring subjection of the printed postage indicium to an intensity of light in excess of ambient light and said postage indicium providing evidence that accounting for a postage charge in respect of said mail item has been effected, including the step of printing the postage indicium with an ink having a characteristic such that when subjected to ambient light the ink is visible and when subjected to said intensity of light in excess of ambient light the ink is rendered invisible whereby the postage indicium printed with said ink and visible in ambient light is rendered invisible when subjected to said intensity of light in excess of ambient light.

2. A method of printing a postage indicium as claimed in claim 1 wherein the ink has a characteristic such that when subjected to a burst of light of sufficient intensity in excess of ambient light the ink is rendered invisible.

3. A method as claimed in claim 2 wherein the mail item bears a void mark and printing of the postage indicium is effected such that the imprint of the postage indicium overlies at least a part of the void mark to render the void mark unrecognisable in ambient light conditions and the imprint of the postage indicium when subjected to the burst of light is rendered invisible and transparent to reveal the void mark on the mail item.

4. A method of printing a postage indicium on a mail item, said postage indicium providing evidence that accounting for a postage charge in respect of said mail item has been effected, including the step of printing the postage indicium with an ink having a characteristic such that the ink is visible when subjected to ambient light and ambient heat and when subjected to light of sufficient intensity in excess of ambient light the ink is rendered invisible whereby the postage indicium printed with said ink and visible in ambient light is rendered invisible thereby preventing copying of said postage indicium in which the imprint of the postage indicium is subjected to light of said intensity in excess of ambient sufficient to render the ink invisible.

5. A method of printing a postage indicium as claimed in claim 4 wherein the ink has a characteristic such that when subjected to a burst of light of sufficient intensity the ink is rendered invisible.

6. A method as claimed in claim 5 wherein the mail item bears a void mark and printing of the postage indicium is effected such that the imprint of the postage indicium overlies at least a part of the void mark to render the void mark unrecognisable in ambient light conditions and the imprint of the postage indicium when subjected to the burst of light is rendered invisible and transparent to reveal the void mark on the mail item.

7. A method as claimed in claim 4 wherein the mail item is an item bearing a pre-printed void mark.

8. A method as claimed in claim 4 including the steps of printing the void mark on the mail item and thereafter printing the postage indicium to overly and at least partially obscure the printed void mark on the mail item.

9. Postage metering apparatus including electronic accounting and control means operable in a franking operation to carry out accounting functions in respect of a postage charge to be applied in respect of a mail item; a first print head operable to form a first imprint on the mail item with a first ink having a first characteristic such that said first imprint is visible in normal ambient light conditions and is rendered invisible in response to subjection of the imprint to a burst of light of sufficient intensity; a second print head operable to form second imprint on the mail item with a second ink having a second characteristic such that the second imprint is visible under normal ambient conditions and remains visible when subjected to said burst or light; and said electronic accounting and control means being further operable in said franking operation to effect operation of said second print head to print said second imprint as a marking on the mail item and to effect operation of the first print head to print said first imprint as a postage indicium on the mail item providing evidence of accounting for said postage charge; said first print head being so operated that the postage indicium overlies at least a part of said marking printed by said second print head.

10. Postage metering apparatus as claimed in claim 9 wherein the electronic accounting and control means is operable in the franking operation to control operation of the second print head to print the marking as a void mark indicating a void mail item.

11. A method of preventing copying of a postage indicium printed on a mail item, said copying requiring subjection of the printed postage indicium to an intensity of light and heat in excess of normal ambient conditions and said postage indicium providing evidence that accounting for a postage charge in respect of said mail item has been effected, including the step of printing the postage indicium with an ink having a characteristic that under normal ambient conditions the ink is visible and when subjected to light and heat of sufficient intensity the ink is rendered invisible whereby the postage indicium printed with said ink visible under normal ambient conditions but is rendered invisible.

12. A mail item bearing a first imprint that is humanly visible in normal ambient light conditions and remains visible when subjected to an intensity of light higher than said normal ambient light conditions and a second imprint that is visible in said normal ambient light conditions and is invisible and transparent when subjected to said intensity of light higher than said normal ambient light conditions; said second imprint overlying at least a part of said first imprint and thereby in normal ambient light conditions obscuring said part of the first imprint and when subjected to said intensity of light higher than normal ambient light revealing said part of the first imprint.

* * * * *